US009976759B2

(12) United States Patent
Eskew et al.

(10) Patent No.: US 9,976,759 B2
(45) Date of Patent: May 22, 2018

(54) RAIN SHIELD FOR A HEAT EXCHANGER COMPONENT

(71) Applicant: Johnson Controls Technology Company, Plymouth, MI (US)

(72) Inventors: Robert L. Eskew, Kingman, KS (US); Jeremiah M. Horn, Derby, KS (US); Nicholas A. Kauffman, Wichita, KS (US); Paul Lucas, Wichita, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days. days.

(21) Appl. No.: 15/398,610

(22) Filed: Jan. 4, 2017

(65) Prior Publication Data

US 2017/0248328 A1 Aug. 31, 2017

Related U.S. Application Data

(60) Provisional application No. 62/301,380, filed on Feb. 29, 2016.

(51) Int. Cl.
*F24F 1/22* (2011.01)

(52) U.S. Cl.
CPC ..... *F24F 1/22* (2013.01); *F24F 2221/52* (2013.01)

(58) Field of Classification Search
CPC .. F24F 1/22; F24F 2221/52; F24F 1/24; F24F 1/46; F24F 1/60; F24F 1/10; F24F 1/40; F24F 1/16; F24F 1/36; F24F 1/38; F24F 1/20; F24F 1/12; F24F 1/18; F24F 1/54
USPC ..... 62/56, 498; 165/104.34
See application file for complete search history.

(56) References Cited

U.S. PATENT DOCUMENTS 6,427,461 B1 * 8/2002 Whinery ..... F24F 3/153 62/176.6
2003/0192331 A1 * 10/2003 Alford ..... F24F 3/1405 62/173
2010/0011803 A1 * 1/2010 Warnecker ..... F24F 1/12 62/498

* cited by examiner

*Primary Examiner* — Mohammad M Ali
(74) *Attorney, Agent, or Firm* — Fletcher Yoder, P.C.

(57) ABSTRACT

A system includes a coil of an outdoor unit, where tubing forming the coil is configured to circulate a refrigerant therethrough, a fan configured to direct air from within an inner chamber formed by a structure of the coil such that air is in a heat exchange relationship with the refrigerant, a motor located within the inner chamber, where the motor is configured to rotate the fan, a panel coupled to the coil, a fan controller mounted to the panel such that the fan controller is positioned within the inner chamber remote from the fan and the motor, where the fan controller is coupled to the motor, and the fan controller is configured to supply power to the motor to adjust a speed of the fan, and a rain shield disposed over the fan controller and configured to block contaminants from entering a housing of the fan controller.

20 Claims, 11 Drawing Sheets

FIG. 1
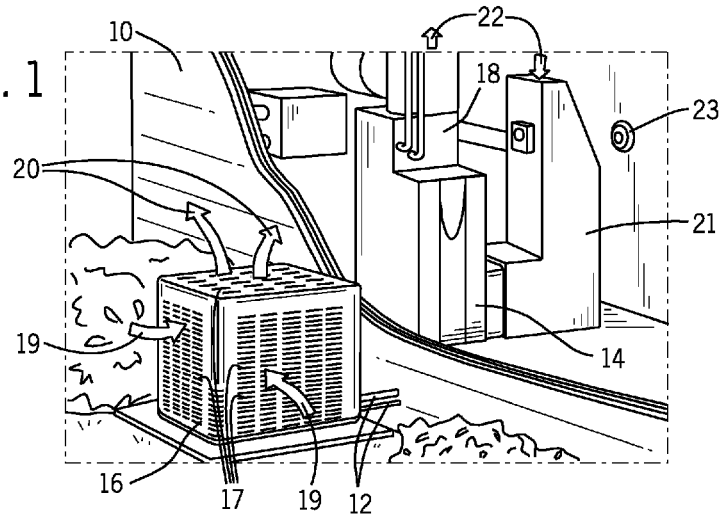
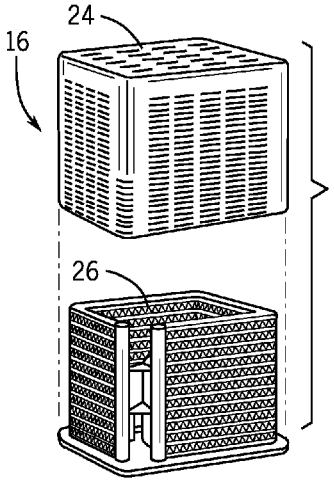
FIG. 2
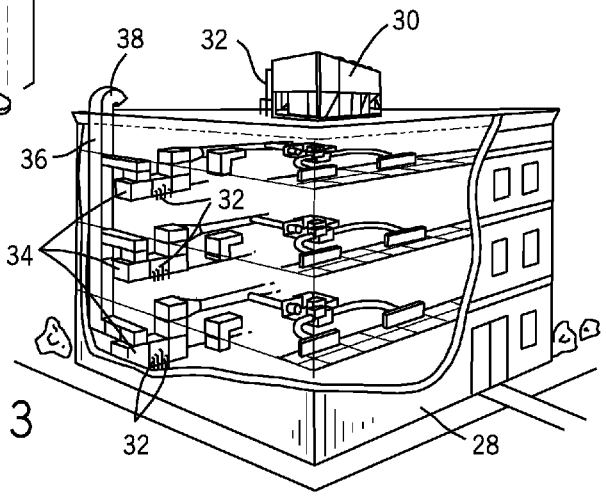
FIG. 3

RAIN SHIELD FOR A HEAT EXCHANGER COMPONENT

CROSS REFERENCE TO RELATED APPLICATIONS

This application claims priority from and the benefit of U.S. Provisional Application Ser. No. 62/301,380, filed Feb. 29, 2016, entitled "RAIN SHIELD FOR A HEAT EXCHANGER COMPONENT," the disclosure of which is hereby incorporated by reference in its entirety for all purposes.

BACKGROUND

The present disclosure relates generally to refrigeration systems. Specifically, the present disclosure relates to a rain shield for a heat exchanger component.

Heat exchangers are used in a variety of settings and for many purposes. For example, liquid-to-air heat exchangers are used throughout industry and in many heating, ventilating, air conditioning, and refrigeration applications. The latter applications include residential, commercial, and industrial air conditioning systems in which heat exchangers serve as both condensers and evaporators in a thermal cycle. In general, when used as an evaporator, liquid or primarily liquid refrigerant enters a heat exchanger and is evaporated to draw thermal energy from an air flow stream that is drawn over the heat exchanger tubes and fins. When used as a condenser, the refrigerant enters in a vapor phase (or a mixed phase) and is de-superheated, condensed, and sub-cooled in the condenser. In some cases, space in an outdoor unit (e.g., heat exchanger) may be limited such that a controller or other heat exchanger component may be positioned outside of an enclosed compartment, thereby exposing the controller or other heat exchanger component to contaminants (e.g., environmental elements) present in an ambient environment.

DRAWINGS

FIG. 1 is a perspective view of a residential air conditioning or heat pump system that utilizes a heat exchanger, in accordance with an aspect of the present disclosure;

FIG. 2 is a partially exploded view of an outdoor unit of the system of FIG. 1, in accordance with an aspect of the present disclosure;

FIG. 3 is a perspective view of a commercial or industrial system using a heat exchanger and air handlers to cool a building, in accordance with an aspect of the present disclosure;

Figure 14:
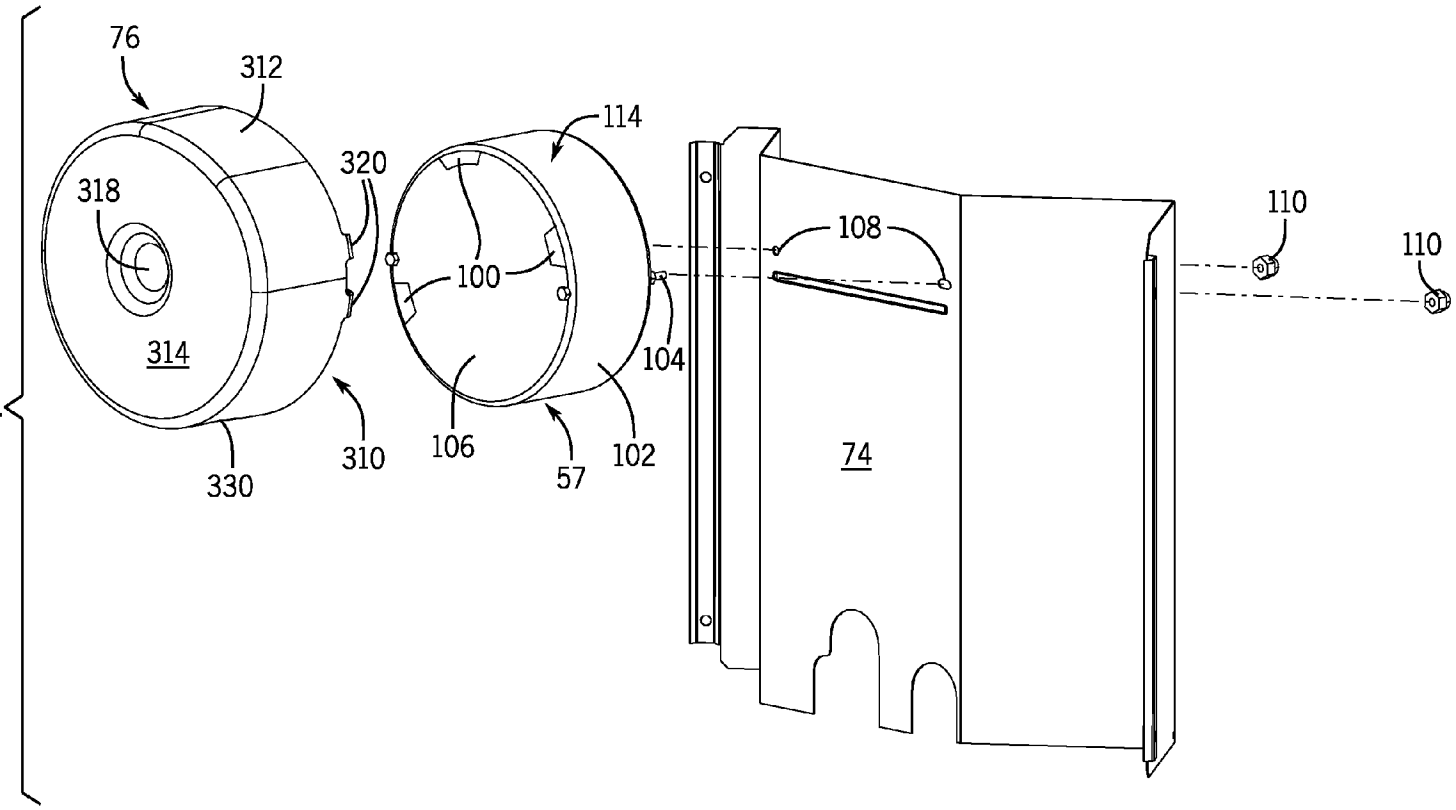
FIG. 14 is an exploded perspective view of another embodiment of a rain shield that includes an open back side or no back side, in accordance with an aspect of the present disclosure.
Figure 15:
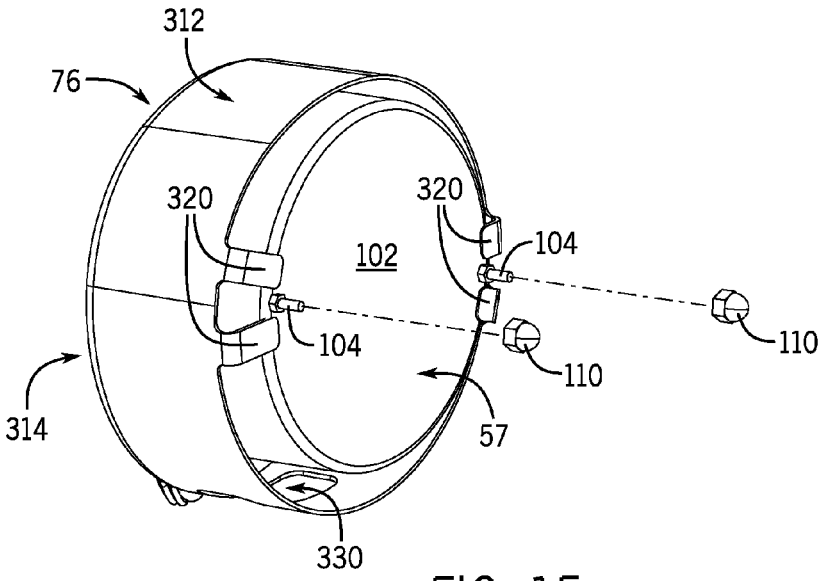
FIG. 15 is a perspective view of the rain shield of FIG. 14 disposed over and secured to the fan controller, in accordance with an aspect of the present disclosure.
Figure 16:
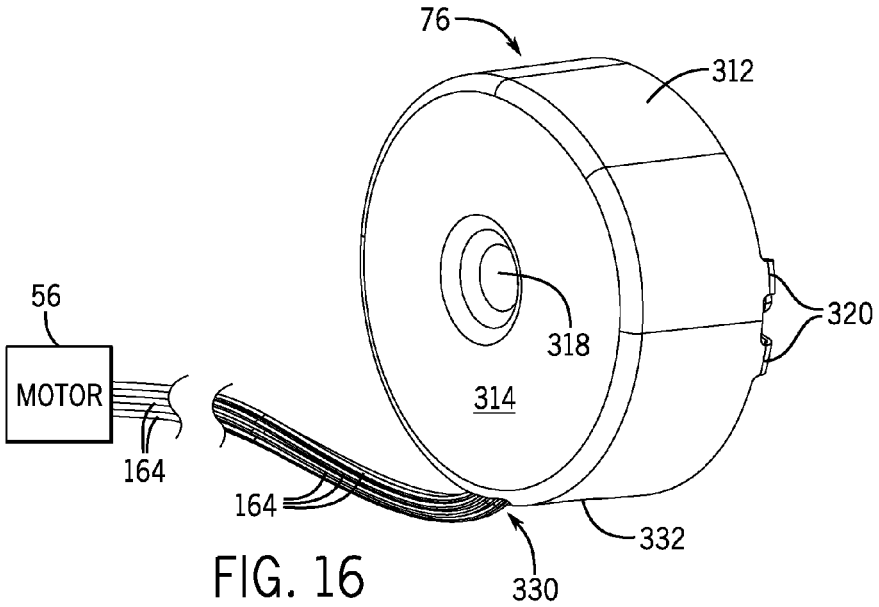
Figure 17:
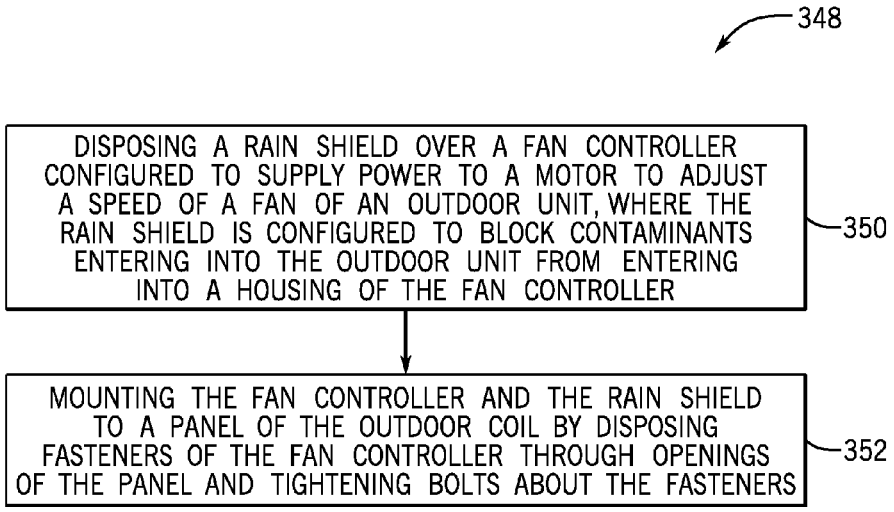

FIG. 16 is a perspective view of the rain shield of FIGS. 14 and 15, illustrating an opening in the rain shield configured to direct wires of the fan controller through the rain shield, in accordance with an aspect of the present disclosure; and FIG. 17 is a block diagram of an embodiment of a process for installing a rain shield in an outdoor unit, in accordance with an aspect of the present disclosure.

DETAILED DESCRIPTION

The present disclosure is directed to a rain shield that may block water and/or other contaminants (e.g., environmental elements) from entering into a housing of a component (e.g., a fan controller) of a heat exchanger. In some outdoor units (e.g., heat exchangers located in an ambient and/or outdoor environment), a fan may be utilized to direct air through a center of a coil that circulates a fluid (e.g., a refrigerant). The air may absorb heat from, or transfer heat to, the fluid within the coil to ultimately heat or cool a load (e.g., a building). The fan may be driven (e.g., rotated) by a fan motor, which may be controlled by a controller. For example, the controller may selectively supply power to the fan motor to adjust a speed of the fan (e.g., a speed of rotation). In some embodiments, it may be desirable to mount the controller in a location remote from the fan motor and/or the fan. For example, the fan may operate with reduced efficiency when the controller is located proximate the fan (e.g., the controller may obstruct air flow and/or impede movement of the fan). Accordingly, some outdoor units mount the controller away from the fan but may include wiring that electrically couples the controller to the fan motor. However, available space within an outdoor unit may be limited due to numerous other components included in the outdoor unit and/or a desire to reduce the size of outdoor units.

In accordance with embodiments of the present disclosure, the controller may be mounted to a panel that supports a swinging control box within the outdoor unit (e.g., the covered, swinging control box may not have room to house the controller). However, mounting the controller to the panel may create or expose various openings (e.g., gaps, slots, or holes) in a housing of the controller to water and/or other contaminants that may be present around and/or within the outdoor unit. Therefore, it is now recognized that it may be desirable to dispose a rain shield over the controller to block water and/or other contaminants from entering into the housing of the controller, thereby protecting the controller from potential damage caused by such contaminants. It should be noted that while the present discussion focuses on the controller mounted to the panel, the controller may be mounted in any location of the outdoor unit that may expose the controller to water and/or other contaminants. Protecting the controller may lead to an increased life span of the fan controller, which may enhance fan efficiency, and thus, enhance efficiency of the outdoor unit.

Turning now to the figures, FIGS. 1 through 3 depict exemplary applications for heat exchangers. Such systems, in general, may be applied in a range of settings, both within the heating, ventilating, air conditioning, and refrigeration (HVAC&R) field and outside of that field. In presently contemplated applications, however, heat exchangers may be used in residential, commercial, light industrial, industrial, and/or in any other application for heating or cooling a volume or enclosure, such as a residence, building, structure, and so forth. Moreover, the heat exchangers may be used in industrial applications, where appropriate, for basic refrigeration and heating of various fluids. FIG. 1 illustrates a residential heating and cooling system. In general, a residence 10 may include refrigerant conduits 12 that operatively couple an indoor unit 14 to an outdoor unit 16. The indoor unit 14 may be positioned in a utility room, an attic, a basement, or other location. The outdoor unit 16 is typically situated adjacent to a side of the residence 10 and is covered by a shroud to protect the system components and to block some contaminants (e.g., dirt, leaves, rain) from entering the unit 16. However, in some cases, contaminants may still enter the unit 16 via one or more openings 17 within the shroud. Nevertheless, the refrigerant conduits 12 may transfer refrigerant between the indoor unit 14 and the outdoor unit 16, typically transferring primarily liquid refrigerant in one direction and primarily vaporized refrigerant in an opposite direction.

When the system shown in FIG. 1 is operating as an air conditioner, a coil in the outdoor unit 16 (e.g., outdoor coil) may serve as a condenser for re-condensing vaporized refrigerant flowing from the indoor unit 14 to the outdoor unit 16 via one of the refrigerant conduits 12. In these applications, an evaporator coil 18 of the indoor unit 14 may receive liquid refrigerant (which may be expanded by an expansion device, not shown) and evaporate the refrigerant before returning it to the outdoor unit 16.

The outdoor unit 16 may draw in ambient air through its sides, as indicated by arrows 19 directed to the sides of the unit 16, force the air through the outer unit coil (e.g., outdoor coil) by a means of a fan (not shown), and expel the air, as indicated by arrows 20 above the outdoor unit 16. When operating as an air conditioner, the air may be heated by the coil (e.g., outdoor coil) within the outdoor unit 16 and exit the top of the unit 16 at a temperature higher than when it entered the sides of the outdoor unit 16. Air may be blown over indoor coil 18 and then circulated through residence 10 by means of ductwork 21, as indicated by arrows 22 entering and exiting the ductwork 21. The overall system operates to maintain a desired temperature as set by a thermostat 23, for example. When the temperature sensed inside the residence 10 is higher than the set point on the thermostat 23 (plus a small amount), the air conditioner may operate to refrigerate additional air for circulation through the residence 10. When the temperature reaches the set point (minus a small amount), the unit may stop the refrigeration cycle temporarily.

When the unit 16 in FIG. 1 operates as a heat pump, the roles of the coils may simply be reversed. That is, the coil of outdoor unit 16 (e.g., outdoor coil) may serve as an evaporator to evaporate refrigerant and thereby cool air entering the outdoor unit 16 as the air passes over the outdoor unit 16 coil. Additionally, the indoor coil 18 may receive a stream of air blown over it and heat the air by condensing the refrigerant.

FIG. 2 illustrates a partially exploded view of the outdoor unit 16 shown in FIG. 1. In general, the outdoor unit 16 may include an upper assembly made up of a shroud 24, a fan assembly, a motor, and so forth. In the illustrated embodiment of FIG. 2, the fan and the motor are not visible because they are hidden by the surrounding shroud 24. An outdoor coil 26 is housed within the shroud 24 and may generally surround, or at least partially surround, other system components, such as a compressor, an expansion device, a fan controller, and/or an outdoor unit control circuit.

FIG. 3 illustrates another application of presently disclosed embodiments, in this case an HVAC&R system for building environmental management. A building 28 may be cooled by a system that includes a chiller 30 (e.g., the outdoor unit 16 and/or the indoor unit 14), which is typically disposed on or near the building 28, or in an equipment room or basement. The chiller 30 may be an air-cooled device that implements a refrigeration cycle to cool water, for example. The water (e.g., refrigerant) may then be circulated to the building 28 through water conduits 32. The water conduits 32 may route the water to air handlers 34 at individual floors or sections of the building 28. The air handlers 34 may also be coupled to ductwork 36 adapted to blow air from an outside intake 38.

The chiller 30, which may include heat exchangers for both evaporating and condensing a refrigerant as described above, may cool water (e.g., refrigerant) that is circulated to the air handlers 34. Air blown over additional coils that receive the water in the air handlers 34 may cause the water to increase in temperature and the circulated air to decrease in temperature. The cooled air is then routed to various locations in the building 28 via additional ductwork. Ultimately, distribution of the air is routed to diffusers that deliver the cooled air to offices, apartments, hallways, and any other interior spaces within the building 28. In many applications, thermostats or other command devices (not shown in FIG. 3) will serve to control the flow of air through and from the individual air handlers 34 and ductwork 36 to maintain desired temperatures at various locations in the building 28.

Figure 4:
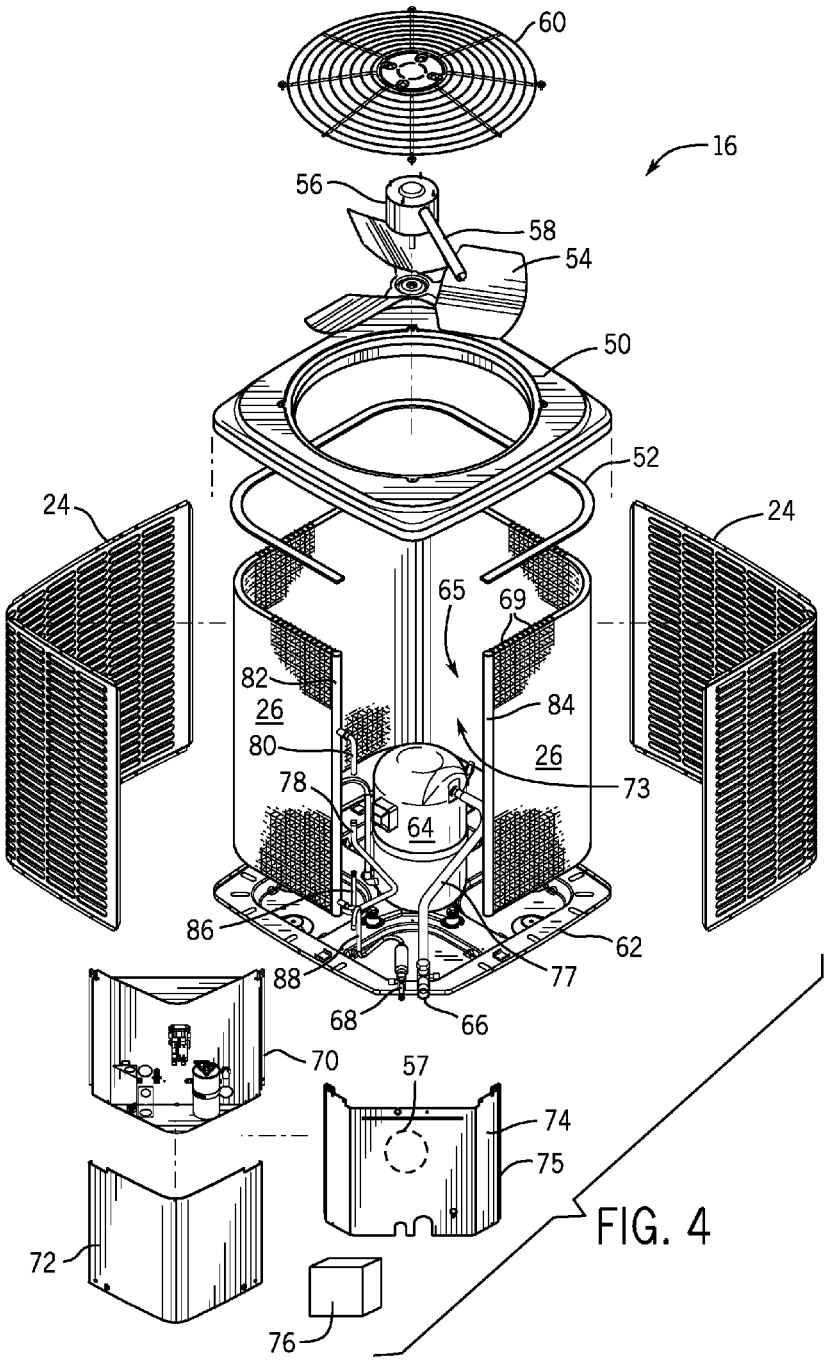
FIG. 4 is an exploded view of an outdoor unit, in accordance with an aspect of the present disclosure.

FIG. 4 illustrates a partially exploded view of the outdoor unit 16. As shown in the illustrated embodiment, the shroud 24 may have two or more pieces configured to surround the sides of the unit 16 and to protect system components from dirt, rain, leaves, and/or other contaminants (e.g., environmental elements). The outdoor coil 26 may be positioned adjacent to the shroud 24, and a cover 50 may enclose a top portion of the outdoor coil 26. Foam 52 may be disposed between the cover 50 and the outdoor coil 26 to block air flow in a void between the cover 50 and the outdoor coil 26. A fan 54 may be located within an opening of the cover 50 and may be powered by a motor 56. A wire way 58 may be used to connect the motor 56 to a power source to power the fan 54. Additionally, in some embodiments, the wire way 58 may also lead to a fan controller 57 that may be configured to selectively supply power to the motor 56, and thereby adjust a speed of the fan 54. Accordingly, the fan 54 may rotate at a speed predetermined by the fan controller 57, and the speed may be based on the amount of power supplied to the motor 56. A fan guard 60 may be disposed within the cover 50 and above the fan 54 to prevent objects (e.g., contaminants) from entering and/or contacting the fan 54.

In certain embodiments, the outdoor coil 26 may be mounted on a base pan 62. The base pan 62 may provide a mounting surface and structure for the internal components of the unit 16. A compressor 64 may be disposed within the center of the unit 16 in an inner chamber 65 of the coil 26 and may be connected to another unit within the HVAC&R system, for example the indoor unit 14, by connections 66 and 68. As shown in the illustrated embodiment of FIG. 4, the inner chamber 65 may be formed by a structure of the coil 26 such that air flowing through the inner chamber 65 is in a heat exchanger relationship with fluid flowing through tubing 69 of the coil 26. The connections 66 and 68 may be configured to connect the unit 16 to conduits circulating refrigerant within the HVAC&R system.

Additionally, a control box 70 may house control circuitry for the outdoor unit 16 and may be protected by a cover 72. In some embodiments, the control box 70 may pivot with respect to an opening 73 of the coil 26, such that the compressor 64 and other components located in the inner chamber 65 of the coil 26 may be accessible for maintenance. In certain embodiments, a panel 74 may be used to mount the control box 70 to the unit 16. For example, the panel 74 may be mounted to the coil 26 (e.g., using mounting brackets) and/or to the base pan 62. The control box 70 may be coupled to at least a first edge 75 of the panel 74 such that the control box 70 may pivot about the first edge 75, thereby exposing the opening 73 in the coil 26 such that the inner chamber 65 may be accessed. As shown in the illustrated embodiment, of FIG. 4, the fan controller 57 may also be mounted to the panel 74 in a vertical orientation (e.g., a circular cross-section of the fan controller 57 is vertical with respect to the base pan 62). Additionally, the fan controller 57 may be mounted to the panel 74 such that the fan controller 57 faces the opening 73 (e.g., the fan controller 57 is disposed in the inner chamber 65 of the coil 26). Accordingly, one or more openings within a housing of the fan controller 57 may be exposed to contaminants (e.g., environmental elements and/or water) that may enter the unit 16 through the shroud 24. Therefore, a rain shield 76 may be disposed over the fan controller 57 to block such contaminants from entering into the housing of the fan controller 57. The rain shield 76 will be discussed in greater detail herein with reference to FIGS. 5-17.

Vaporous refrigerant may enter the unit 16 through the connection 66 and flow through a conduit 77 into the compressor 64. In certain embodiments, the vaporous refrigerant may be received from the indoor unit 14 (not shown). After undergoing compression in the compressor 64, the refrigerant may exit the compressor 64 through a conduit 78 and enter the outdoor coil 26 through inlet 80. The inlet 80 may direct the refrigerant into a first header 82 (e.g., a first manifold). From the first header 82, the refrigerant may flow through the outdoor coil 26 to a second header 84 (e.g., a second manifold). From the second header 84, the refrigerant may flow back through the outdoor coil 26 and exit through an outlet 86 disposed on the first header 82. After exiting the outdoor coil 26, the refrigerant may flow through conduit 88 to connection 68 to return to the indoor unit 14, for example, where the process may begin again. It should be noted that, while the illustrated embodiment of FIG. 4 shows the inlet 80 and the outlet 86 located on the first header 82, the inlet 80 and/or the outlet 86 may be positioned on the second header 84.

Figure 5:
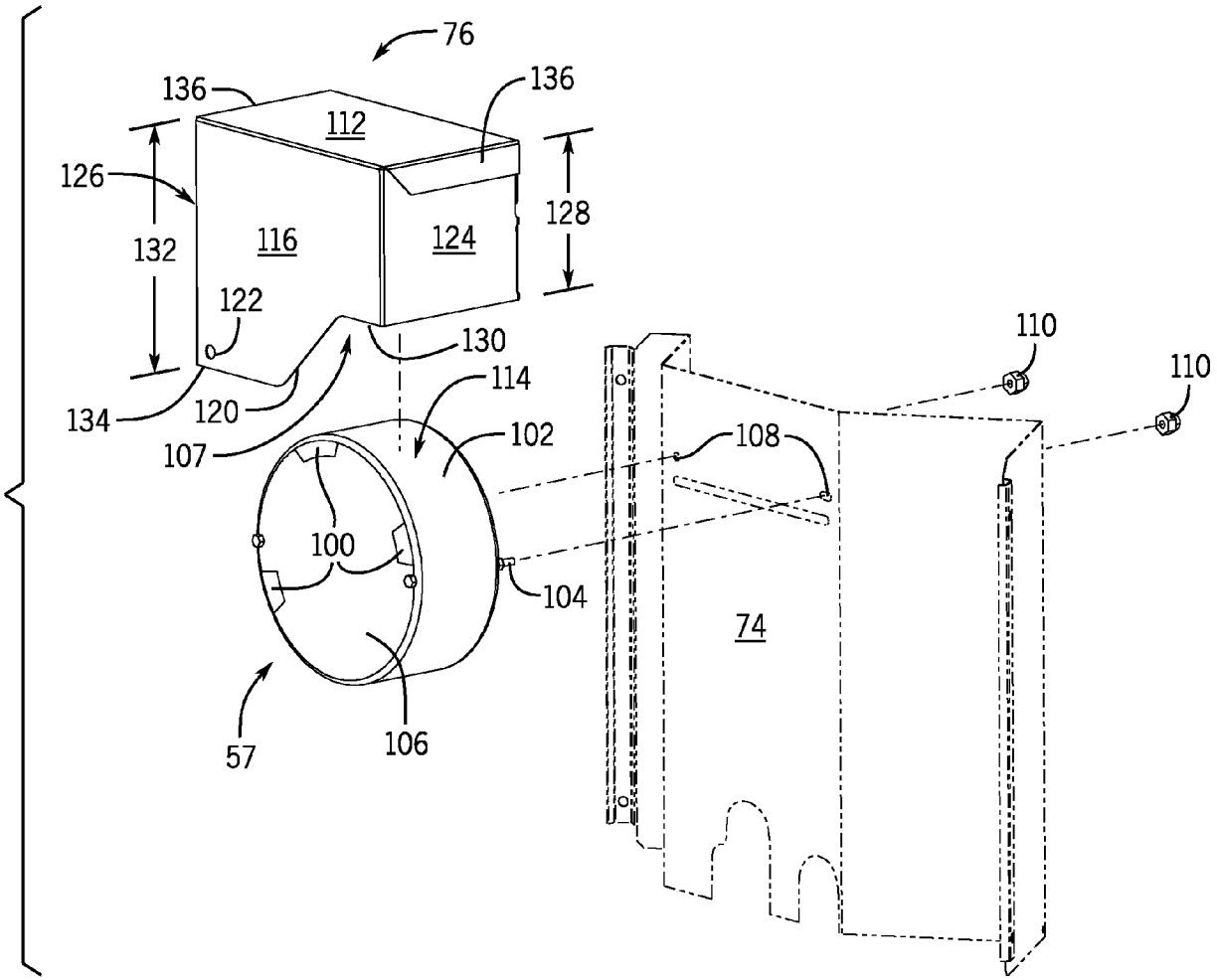
FIG. 5 is an exploded perspective view of an embodiment of a rain shield that may be utilized to cover a fan controller of the outdoor unit of FIG. 4, in accordance with an aspect of the present disclosure.

As discussed above, the fan controller 57 may be mounted in a location within the outdoor unit 16 that exposes openings 100 in a housing 102 of the fan controller 57 to contaminants (e.g., environmental elements) that may enter the outdoor unit 16 through the shroud 24 (e.g., via one or more openings in the shroud 24), as shown in FIG. 5. Accordingly, the rain shield 76 may be disposed over the fan controller 57 to cover the openings 100 and block the contaminants from entering into the housing 102 of the fan controller 57. Blocking contaminants from entering into the housing 102 of the fan controller 57 may enhance an operating life span of the fan controller 57, thereby reducing maintenance time and/or costs associated with operating the outdoor unit 16. The rain shield 76 may be formed from a variety of materials (e.g., metals and/or plastics) and include various configurations that cover the fan controller 57 and substantially block contaminants from entering the housing 102 of the fan controller 57.

For example, FIG. 5 is an exploded perspective view of an embodiment of the rain shield 76 that may be utilized to cover the fan controller 57. As shown in the illustrated embodiment, the rain shield 76 may be disposed over the fan controller 57, and fasteners 104 (e.g., through bolts) that hold a cover 106 of the fan controller 57 to the housing 102 may be disposed through openings (e.g., FIG. 6) of the rain shield 76. The rain shield 76 may include an opening 107 (e.g., a cavity) that is configured to receive the fan controller 57 and substantially enclose the fan controller 57 (e.g., cover at least 75% of a surface area of the fan controller 57). In some embodiments, the rain shield 76 and the fan controller 57 may be coupled to (e.g., fastened) the panel 74. As shown in the illustrated embodiment of FIG. 5, the fasteners 104 may extend through holes 108 in the panel 74, and nuts 110 (e.g., acorn nuts) may be tightened about the fasteners 104 to secure the fan controller 57 and the rain shield 76 to the panel 74. Accordingly, the panel 74 may support the fan controller 57 and the rain shield 76 within the outdoor unit 16.

In certain embodiments, the rain shield 76 may include a metallic material. For example, the rain shield 76 may be formed from a soft sheet metal and manipulated (e.g., cut, bent, and worked) into a desired shape (e.g., the box shape of FIG. 5). As a non-limiting example, the rain shield 76 may include galvanized sheet metal, such as 0.033 inch thick, grade G90, galvanized sheet metal. In embodiments that include such metallic material, the rain shield 76 may be formed by a soft tooling technique. In other embodiments, the rain shield 76 may include any suitable material that may block contaminants from entering the housing 102 of the fan controller 57, and the rain shield 76 may be formed using any suitable technique for producing a desired configuration (e.g., a box shape or a cylindrical shape).

As shown in the illustrated embodiment of FIG. 5, the rain shield 76 is substantially box-shaped. The rain shield 76 may include a rectangular top plate 112 having an inner surface that contacts a cylindrical surface 114 of the fan controller 57 when the rain shield 76 is disposed over the fan controller 57 (e.g., when the fan controller 57 is inserted into the opening 107). In other embodiments, the inner surface of the rectangular top plate 112 may not contact the cylindrical surface 114, but may be positioned proximate to the cylindrical surface 114. The rain shield 76 may also include a polygonal plate 116 that may face the cover 106 of the fan controller 57. In certain embodiments, the polygonal plate 116 may include a bottom edge 120 that includes a "Z"-shape configuration. The "Z"-shape configuration of the bottom edge 120 may enable one or more wires (not shown) of the fan controller 57 to extend from the fan controller 57 toward the motor 56 while blocking contaminants from entering into the housing 102 via an opening that enables a connection between electrical components of the fan controller 57 within the housing 102 and the wires. Additionally, the bottom edge 120 may guide the wires along a predetermined path toward the motor 56 without creating an obstruction within the outdoor unit 16. The polygonal plate 116 may also include an opening 122 that may be utilized to secure and/or guide the wires toward the motor 56. The opening 122 is discussed in further detail below with reference to FIG. 7.

The rain shield 76 may further include a first side plate 124 and a second side plate 126. The first side plate 124 may include a height 128 that extends from the rectangular top plate 112 to a first side 130 of the bottom edge 120. Additionally, the second side plate 126 may include a height 132 that extends from the rectangular top plate 112 to a second side 134 of the bottom edge 120. In certain embodiments, the height 128 and the height 132 may not be equal (e.g., the height 128 is less than the height 132 or vice versa). In other embodiments, the height 128 and the height 132 may be substantially equal. In any case, the height 128 and the height 132 may depend at least on the configuration of the bottom edge 120 and/or a desired path of the wires extending from the fan controller 57 to the motor 56.

The rectangular top plate 112 of the rain shield 76 may include flaps 136 that may be folded over the first side plate 124 and the second side plate 126. Accordingly, any gaps that may be formed between the rectangular top plate 112 and the first side plate 124 and/or the second side plate 126 (e.g., during construction of the rain shield 76) may be substantially covered. Thus, any contaminants that enter into the outdoor unit 16 may be blocked from entering the housing 102 of the fan controller 57.

Figure 6:
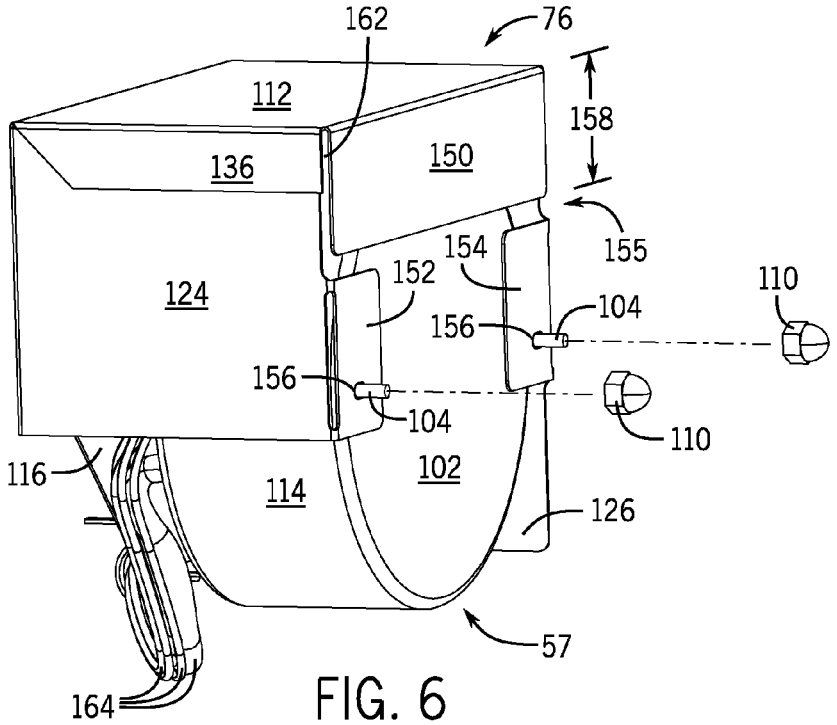
FIG. 6 is a perspective view of a back side of the fan controller and the rain shield of FIG. 5, in accordance with an aspect of the present disclosure.

The rectangular top plate 112 may further include a securement flap 150, the first side plate 124 may include a first fastening tab 152, and the second side plate 126 may include a second fastening tab 154, as shown in FIG. 6. Specifically, FIG. 6 is a perspective view of a back side 155 of the fan controller 57 and the rain shield 76. As shown in the illustrated embodiment, the fasteners 104 extend through respective openings 156 in the first and second fastening tabs 152 and 154. Accordingly, when the fasteners 104 are positioned through openings within the panel 74, the nuts 110 may be tightened on the fasteners 104, thereby securing both the fan controller 57 and the rain shield 76 to the panel 74.

In certain embodiments, the securement flap 150 may be folded over the fan controller 57. The securement flap 150 may extend a distance 158 along the housing 102 of the fan controller 57. The distance 158 may be predetermined such that the securement flap 150 substantially blocks any contaminants (e.g., water and/or dirt) from entering into the housing 102 of the fan controller 57. For example, contaminants may be directed away from the openings 100 in the fan controller housing 102 by the securement flap 150. The securement flap 150 may direct contaminants down the back side 155 of the housing 102 (e.g., as a result of gravity). The back side 155 of the housing 102 may not include the openings 100 that enable contaminants to enter into the housing 102, such that contact between the back side 155 of the fan controller 57 and the contaminants may not allow the contaminants to enter into the housing 102. Additionally, the securement flap 150 may be configured to block movement of the fan controller 57 within the rain shield 76. For example, the securement flap 150 in addition to the fasteners 104 disposed within the openings 156 may enable the rain shield 76 to remain substantially stationary with respect to the fan controller 57.

In some embodiments, gaps 162 may exist between the securement flap 150 and the flaps 136. However, contaminants that may enter such gaps 162 may still be directed away from the openings in the housing 102 (e.g., via gravity directing the contaminants along the cylindrical surface 114), such that the contaminants are blocked from entering into the housing 102 of the fan controller 57.

As shown in the illustrated embodiment of FIG. 6, the fan controller 57 include one or more wires 164 that establish an electrical connection between electrical components within the housing 102 and the motor 56. The wires 164 may be directed from the fan controller 57 toward the motor 56, and in some embodiments, the rain shield 76 may guide the wires 164 along a predetermined path (e.g., a path that may enable a secure connection between the fan controller 57 and the motor 56 without creating an obstruction within the outdoor unit 16 due to the wires 164).

Figure 7:
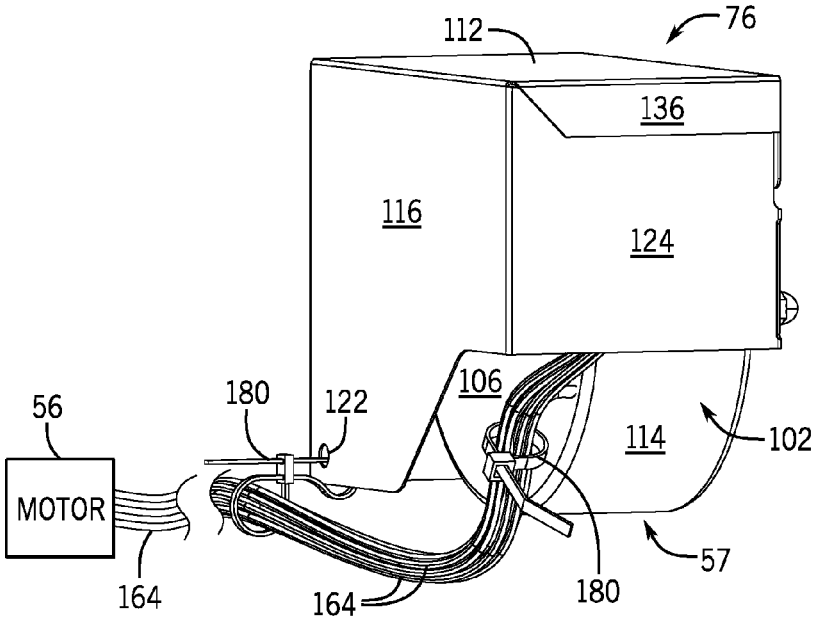
FIG. 7 is a perspective view the rain shield of FIGS. 5 and 6, illustrating features of the rain shield directing wires of the fan controller toward a motor of the outdoor unit, in accordance with an aspect of the present disclosure.

FIG. 7 is a perspective view the rain shield 76 of FIGS. 5 and 6, illustrating the wires 164 being directed toward the motor 56. As shown in the illustrated embodiment of FIG. 7, the wires 164 extend through the cover 106 at a location covered by the rain shield 76. For example, the cover 106 may include additional openings (not shown) that enable the wires 164 to couple to various electronic components (e.g. a processor and/or memory circuitry) within the housing 102. When left uncovered, the additional openings in the cover 106 may enable contaminants to enter into the housing 102, which may ultimately affect performance of the electronic components. Therefore, it may be desirable to cover the additional openings in the cover 106 to block contaminants from entering into the housing 102.

In certain embodiments, the wires 164 may be grouped together via one or more clasps 180. For example, in the illustrated embodiment of FIG. 7, two clasps 180 hold the wires 164 together to form a single strand or bundle of wires. In some embodiments, the polygonal plate 116 may include the opening 122 that may receive one of the clasps 180, such that the wires 164 are positioned proximate to the rain shield 76. Positioning the wires 164 proximate the rain shield 76 may direct the wires 164 along the predetermined path toward the motor 56, and thus, obstructions caused by the wires 164 within the outdoor unit 16 may be substantially avoided.

Figure 8:
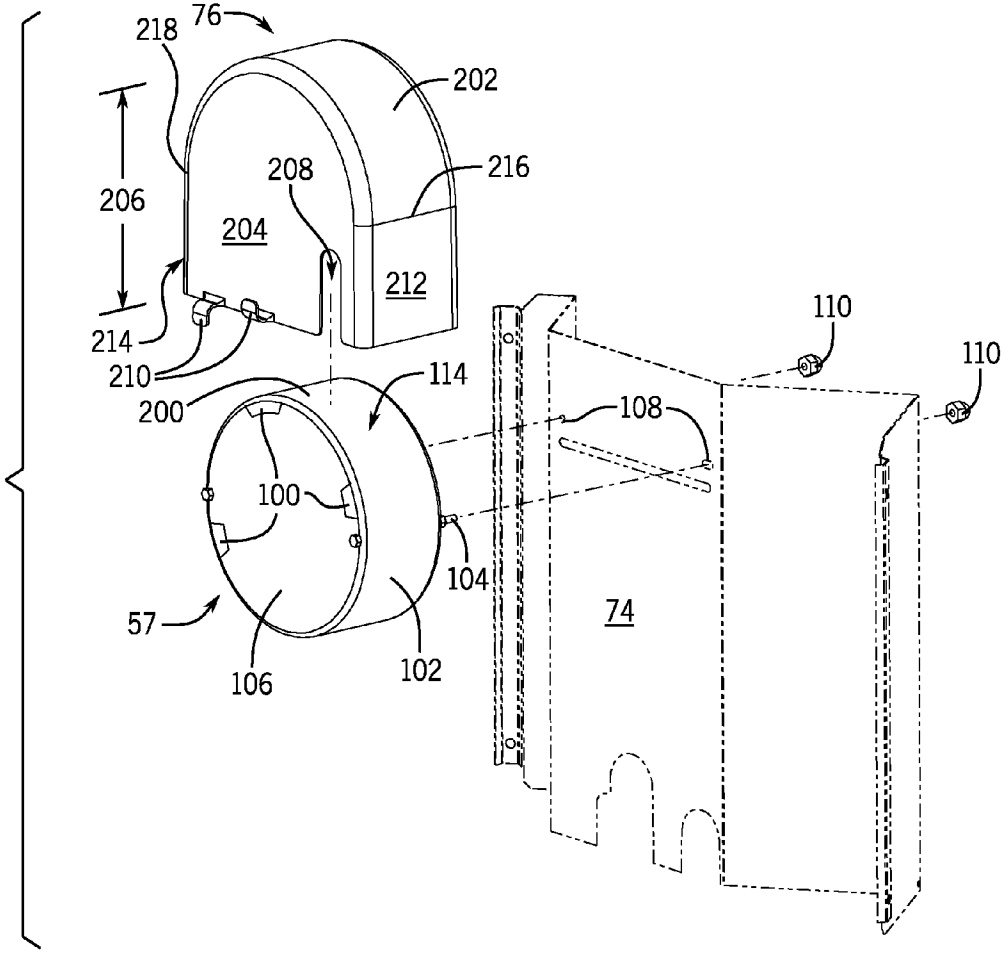
FIG. 8 is a perspective view of another embodiment of a rain shield that may be utilized to cover a fan controller of the outdoor unit of FIG. 4, in accordance with an aspect of the present disclosure.

As discussed above, the rain shield 76 may include other configurations and/or be formed from materials other than metal (e.g., galvanized sheet metal). For example, FIG. 8 is a perspective view of another embodiment of the rain shield 76 that may be formed from a plastic material or any other suitable material that may block contaminants from entering the housing 102 of the fan controller 57. In the illustrated embodiment of FIG. 8, the rain shield 76 includes a semi-circular cross section that substantially conforms to an upper portion 200 of the cylindrical surface 114. For example, the rain shield 76 may include a curved portion 202 that may facilitate conveyance of contaminants away from the fan controller 57 (e.g., away from the openings 100 in the housing 102). Additionally, the semi-circular cross section of the rain shield 76 may utilize less material than the substantially boxed shape of the rain shield 76 shown in FIGS. 5-7, thereby reducing manufacturing costs of the rain shield 76.

In certain embodiments, the rain shield 76 of FIG. 8 may include a plastic material and/or be formed from a mold configured to produce the semi-circular cross section. For example, the rain shield 76 may include a polymeric material (e.g., plastic) that may be configured to substantially block contaminants from entering into the housing 102 of the fan controller 57 via the openings 100. In other words, the contaminants may not permeate through the rain shield 76 toward the fan controller 57. In other embodiments, the rain shield 76 having the configuration of FIG. 8 may be formed from another suitable material for blocking contaminants from entering the housing 102 of the fan controller 57.

As shown in the illustrated embodiment of FIG. 8, the rain shield 76 includes a semi-circular side 204 coupled to the curved portion 202. In certain embodiments, the semi-circular side 204 may include a height 206 configured to cover substantially all of the fan controller 57 when the rain shield 76 is disposed over the fan controller 57 (e.g., at least 75% of the surface area of the fan controller 57 is covered by the rain shield 76). Additionally, the semi-circular side 204 may include a slot 208 that may be utilized to direct the wires 164 toward the motor 56. In some embodiments, the slot 208 may be configured such that the additional opening in the cover 106 that enables a connection between the wires 164 and electrical components of the fan controller 57 is substantially covered. Accordingly, contaminants (e.g., water) may be blocked from entering the housing 102 of the fan controller 57 via the additional opening. Further, the rain shield 76 may include protrusions 210 that may provide support to the wires 164 and direct the wires 164 toward the motor 56 along a predetermined path.

In some embodiments, the rain shield 76 may include a first side portion 212 and a second side portion 214. The first and second side portions 212 and 214 may be coupled to the semi-circular side 204 and the curved portion 202. For example, the first side portion 212 may be coupled a first end 216 of the curved portion 202, and the second side portion 214 may be coupled to a second end 218 of the curved portion 202. In certain embodiments, the first and second side portions 212 and 214 may be molded to the first and second ends 216 and 218 of the curved portion 202, respectively, as well as to the semi-circular side 204. In other embodiments, the first and second side portions 212 and 214 may be coupled to the curved portion 202 and/or the semi-circular side 204 using any suitable technique that forms a substantially water-tight seal.

Figure 9:
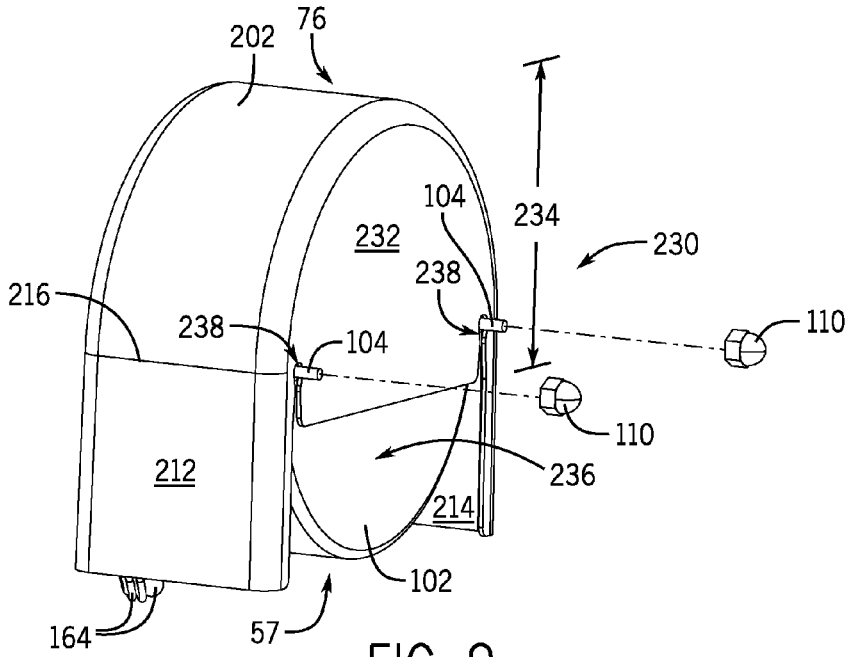
FIG. 9 is a perspective view of a back side of the rain shield of FIG. 8, illustrating features for coupling the rain shield to the fan controller, in accordance with an aspect of the present disclosure.

It should be noted that the fan controller 57 may be secured to the panel 74 in substantially the same manner as described above with reference to FIGS. 5-7. Accordingly, the rain shield 76 of FIG. 8 may also include openings and/or other features that may enable the rain shield 76 to be secured to the fan controller 57 and/or the panel 74. For example, FIG. 9 is a perspective view of a back side 230 of the rain shield 76 that includes features for coupling the rain shield 76 to the fan controller 57 and/or the panel 74. As shown in the illustrated embodiment of FIG. 9, the rain shield 76 includes a second semi-circular side 232. The second semi-circular side 232 may include a height 234. In some embodiments, the height 234 may be less than the height 206 such that a portion 236 of the housing 102 of the fan controller 57 may be exposed before the fan controller 57 and/or the rain shield 76 are mounted to the panel 74. The height 234 of the second semi-circular side 232 may be configured to substantially block contaminants from entering the openings 100 in the housing 102. Additionally, the second semi-circular side 232 may be molded or otherwise coupled to the curved portion 202 of the rain shield 76 such that no gaps are formed between the curved portion 202, the semi-circular side 204, and/or the second-semi circular side 232. Therefore, contaminants may be substantially blocked from entering the openings 100 in the housing 102 of the fan controller 57.

In some embodiments, the rain shield 76 may include slots 238 that are configured to receive the fasteners 104 that secures the cover 106 to the housing 102 as well as the fan controller 57 to the panel 74. Accordingly, the rain shield 76 may be secured to the fan controller 57 (and the panel 74) such that it may block contaminants (e.g., water) from entering the housing 102 of the fan controller 57 when the rain shield 76 is disposed over the fan controller 57. As discussed above, to secure the fan controller 57 and/or the rain shield 76 to the panel 74, the nuts 110 may be tightened onto the fasteners 104.

Figure 10:
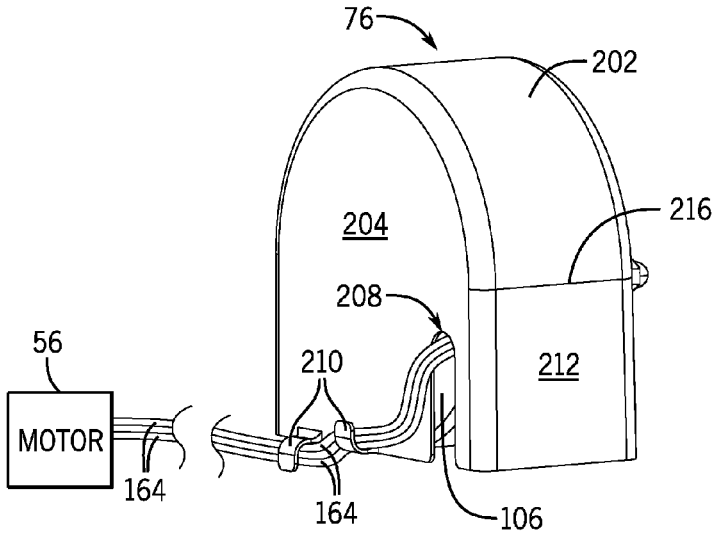
FIG. 10 is a perspective view of the rain shield of FIGS. 8 and 9, illustrating wires being directed along a predetermined path toward the motor, in accordance with an aspect of the present disclosure.

As discussed above, the fan controller 57 may include the wires 164 such that an electrical connection may be established between the electrical components within the housing 102 of the fan controller 57 and the motor 56. Accordingly, the fan controller 57 may adjust an amount of power supplied to the motor 56, which may control a speed of the fan 54 of the outdoor unit 16 to perform a desired amount of heating or cooling. For example, FIG. 10 is a perspective view of the rain shield 76 showing the wires 164 being directed along a predetermined path toward the motor 56. For example, the wires 164 may extend through the cover 106 and toward the slot 208, which may direct the wires 164 out of the rain shield 76. The wires 164 may also be supported by the protrusions 210 that may further guide the wires 164 toward the motor 56 along the predetermined path. The predetermined path may direct the wires 164 through the outdoor unit 16 without the wires 164 causing an obstruction to other components of the outdoor unit 16.

Figure 11:
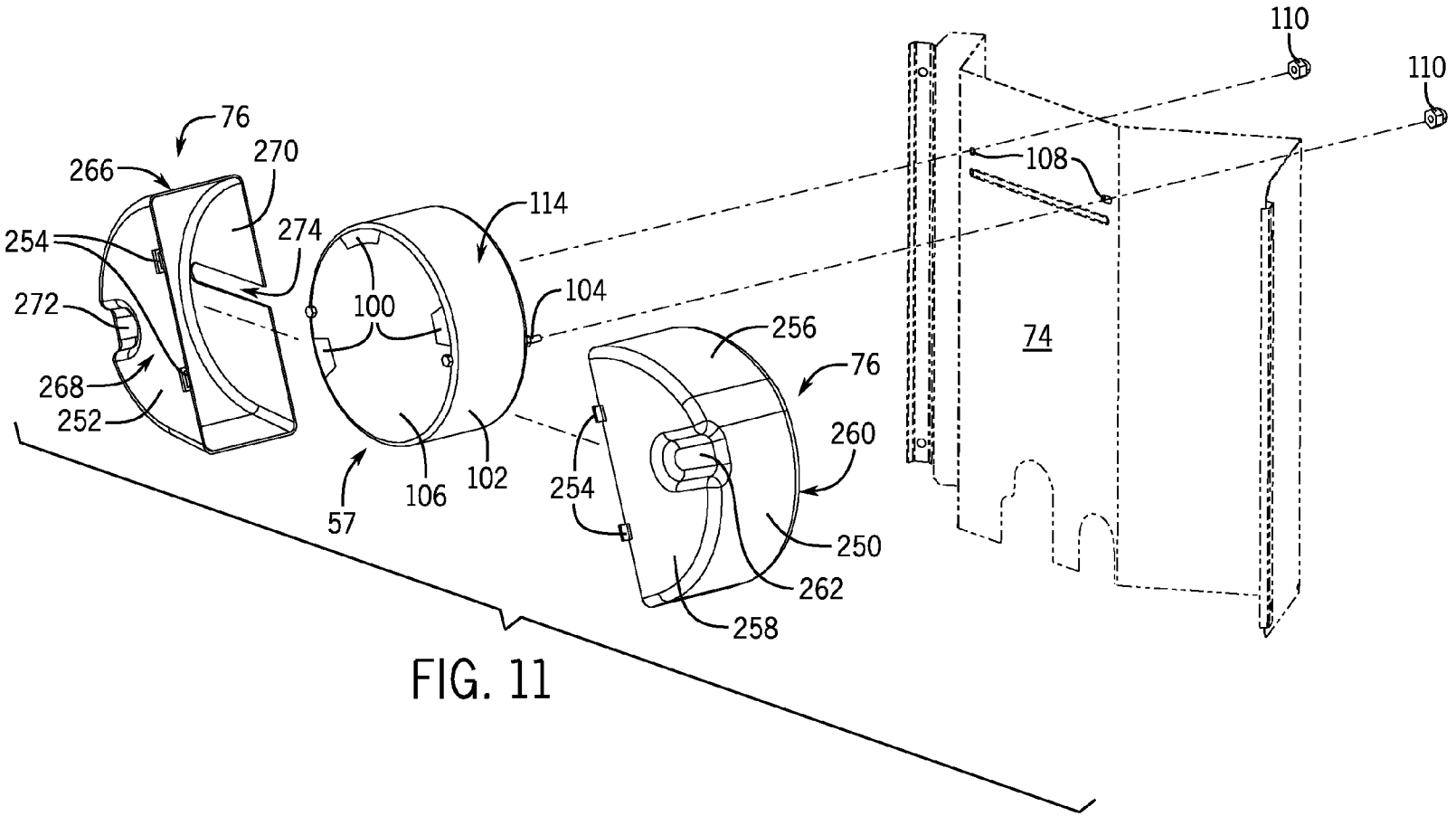
FIG. 11 is a perspective view of another embodiment of a rain shield that includes a first portion and a second portion configured to couple to one another and enclose the fan controller, in accordance with an aspect of the present disclosure.

As discussed above, it may be desirable to dispose the rain shield 76 over the fan controller 57 such that contaminants may be substantially blocked from entering into the housing 102 of the fan controller 57 via the openings 100 of the housing 102. In some embodiments, the rain shield 76 may include a first portion 250 and a second portion 252 that are configured to enclose the fan controller 57 and couple to one another, as shown in FIG. 11. For example, the first and second portions 250 and 252 may include coupling features 254 that may enable the first and second portions 250 and 252 to be secured to one another over the fan controller 57. Accordingly, a manufacturer may dispose the first portion 250 over the fan controller 57 and the second portion 252 over the fan controller 57 and align the coupling features 254 such that the first and second portions 250 and 252 are secured to one another. Additionally, the first portion 250 and the second portion 252 may enclose the fan controller 57, thereby blocking contaminants from entering into the housing 102 of the fan controller 57. In some embodiments, coupling the first and second portions 250 and 252 over the fan controller 57 may form a substantially water-tight seal that blocks contaminants (e.g., water) from entering into rain shield 76 between the first portion 250 and the second portion 252.

As shown in the illustrated embodiment of FIG. 11, the first portion 250 and the second portion 252 are each semi-circular in shape and are substantially mirror images of one another. The first portion 250 may include a curved portion 256, a first semi-circular side 258, and a second semi-circular side 260. In some embodiments, the first semi-circular side 258 may include an indentation 262 that may enable a manufacturer to grip the first portion 250 during assembly and/or disassembly. Additionally, the second semi-circular side 260 may include a slot 264 (e.g., FIG. 12) that may receive one of the fasteners 104 such that the first portion 250 may slide over the fan controller 57 without obstruction caused by the one of the fasteners 104. In certain embodiments, the slot 264 may enable the fan controller 57 to be coupled (e.g., fastened) to the panel 74 before the first portion 250 is slid over the fan controller 57, thereby facilitating assembly (e.g., the rain shield 76 may be disposed over the fan controller 57 after the outdoor unit 16 has been assembled). The curved portion 256 of the first portion 250 may include a curvature substantially similar to the cylindrical surface 114 of the fan controller 57, but the curved portion 256 may include a larger diameter than the cylindrical surface 114 such that the first portion 250 may receive at least a first half of the fan controller 57.

Similarly, the second portion 252 may include a second curved portion 266, a third semi-circular side 268, and a fourth semi-circular side 270. In some embodiments, the third semi-circular side 268 may include an indentation 272 that may enable a manufacturer to grip the second portion 252 during assembly and/or disassembly. Additionally, the fourth semi-circular side 270 may include a second slot 274 that may receive one of the fasteners 104 such that the second portion 252 may slide over the fan controller 57 without obstruction caused by the one of the fasteners 104. As discussed above, the second slot 274 may enable the fan controller 57 to be coupled (e.g., fastened) to the panel 74 before the second portion 252 is slid over the fan controller 57, thereby facilitating assembly (e.g., the rain shield 76 may be disposed over the fan controller 57 after the outdoor unit 16 has been assembled). The second curved portion 266 of the second portion 252 may include a curvature substantially similar to the cylindrical surface 114 of the fan controller 57, but the second curved portion 266 may include a larger diameter than the cylindrical surface 114 such that the second portion 252 may receive at least a second half of the fan controller 57.

Figure 12:
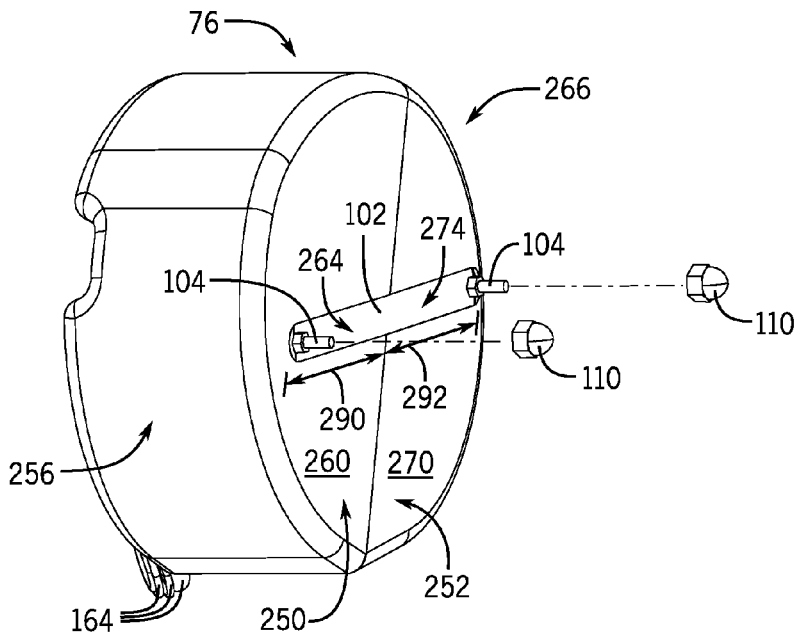
FIG. 12 is a perspective view of the rain shield of FIG. 11 disposed over the fan controller, in accordance with an aspect of the present disclosure.

As discussed above, the slots 264 and/or 274 may be configured to receive the fasteners 104 and enable the first and second portions 250 and 252 to fully enclose the fan controller 57 such that contaminants are blocked from entering the housing 102 of the fan controller 57. For example, FIG. 12 is a perspective view of the rain shield 76 that includes the first and second portions 250 and 252 disposed over the fan controller 57. As shown in the illustrated embodiment of FIG. 12, the slots 264 and/or 274 may enable the first and second portions 250 and 252 to slide over and enclose the fan controller 57 without the fasteners 104 causing an obstruction. In some embodiments, the fan controller 57 may be coupled to the panel 74 before the first and second portions 250 and 252 are slid over the fan controller 57. The slots 264 and 274 may be substantially aligned when the first and second portions 250 and 252 are disposed over the fan controller 57 and coupled to one another. Additionally, the slot 264 may include a length 290 configured to enable the first portion 250 to be fully disposed over at least a first half of the fan controller 57 without obstruction caused by the fastener 104. Similarly, the slot 274 may include a length 292 that is configured to enable the second portion 252 to be fully disposed over at least a second half of the fan controller 57 and couple to the first portion 250 without obstruction caused by the fastener 104.

Accordingly, the fasteners 104 may extend through the first portion 250 and the second portion 252 such that the fasteners 104 may be disposed in the openings 108 of the panel 74. The nuts 110 may then be tightened over the fasteners 104 such that the fan controller 57 and the rain shield 76 (e.g., the first portion 250 and the second portion 252) are secured to the panel 74.

Figure 13:
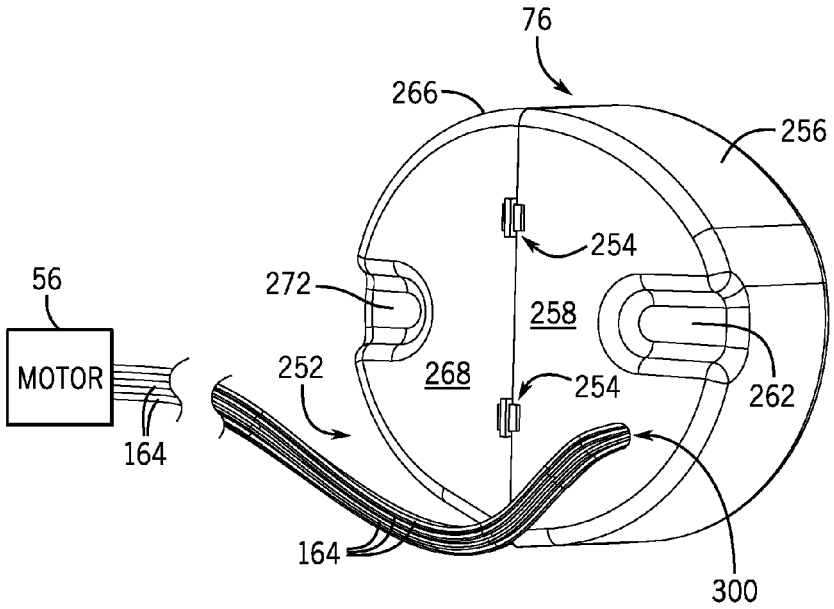
FIG. 13 is a perspective view of the rain shield of FIGS. 11 and 12, illustrating wires extending through the rain shield via an opening in the rain shield, in accordance with an aspect of the present disclosure.

In certain embodiments, the rain shield 76 of FIGS. 11 and 12 may further include an opening 300 configured to receive the wires 164 and enable the wires 164 to be directed toward the motor 56. For example, FIG. 13 is a perspective view of the rain shield 76 showing the wires 164 extending through the rain shield 76 via the opening 300. As shown in the illustrated embodiment of FIG. 13, the opening 300 is positioned in the first portion 250. However, in other embodiments, the opening 300 may located in the second portion 252 and/or in another suitable location in the first portion 250 (e.g., at a bottom of the curved portion 256). In any case, the opening 300 may enable the wires 164 to couple to the electrical components within the housing 102 of the fan controller 57, extend through the rain shield 76, and ultimately couple to the motor 56 to provide power to the fan 54.

In still further embodiments, the rain shield 76 may include a substantially open back side (e.g., no back side or back plate covers the housing 102). For example, FIG. 14 is an exploded perspective view of the rain shield 76 that includes no back side/plate. As shown in the illustrated embodiment of FIG. 14, the rain shield 76 includes an opening 310 that is configured to receive the entire fan controller 57, such that the rain shield 76 couples to the fan controller 57 and substantially blocks contaminants from entering into the housing 102 of the fan controller 57 via the openings 100 of the housing 102. The rain shield 76 may include a cylindrical surface 312 as well as a circular side 314. The cylindrical surface 312 and the circular side 314 may be configured to substantially cover the openings 100 of the housing 102 and direct the contaminants along the cylindrical surface 312 (e.g., due to gravitational forces acting on the contaminants) and away from the openings 100. The circular side 314 may include an indentation 318 that may enable a manufacturer or user to apply a force to the rain shield 76 to secure the rain shield 76 over the fan controller 57.

In embodiments where the rain shield 76 includes the opening 310 (e.g., no back side), the fan controller 57 may be coupled to the panel 74 via the fasteners 104 and the nuts 110 before the rain shield 76 is disposed over the fan controller 57. Accordingly, such a configuration may simplify assembly of the outdoor unit 16. The rain shield 76 may be disposed over the fan controller 57 and secured to the fan controller 57 via securement features 320, as shown in FIG. 15. For example, the rain shield 76 may include one or more securement features 320 (e.g., tabs and/or friction fit interfaces) that snap over the housing 102, thereby securing the rain shield 76 to the fan controller 57, and thus the panel 74. Accordingly, the rain shield 76 may cover the openings 100 in the housing 102 of the fan controller 57 and block contaminants from entering the housing 102.

Further, the rain shield 76 shown in FIGS. 14 and 15 may include an opening 330 configured to receive the wires 164 and direct the wires 164 from within the housing 102 of the fan controller 57, through the rain shield 76, and toward the motor 56. For example, FIG. 16 is a perspective view of the rain shield 76 illustrating the opening 330 directing the wires 164 through the rain shield 76. In the illustrated embodiment of FIG. 16, the opening 330 is disposed on a bottom portion 332 (e.g., with respect to the base pan 62 of the outdoor unit 16) of the cylindrical surface 312 of the rain shield 76. In other embodiments, the opening 330 may be positioned in the circular side 314 and/or in any other suitable location along the cylindrical surface 312.

Ultimately, the rain shield 76 may substantially block contaminants (e.g., water) from entering into the openings 100 of the housing 102, such that an operating life span of the fan controller 57 may be increased. Therefore, maintenance time of the outdoor unit 16 and/or costs associated with operating the outdoor unit 16 may be reduced.

FIG. 17 is a block diagram of an embodiment of a process 348 for installing the rain shield 76 in the outdoor unit 16. For example, at block 350 the rain shield 76 is disposed over the fan controller 57. As discussed above, the fan controller 57 may be electrically coupled to the motor 56 and selectively supply power to the motor 56 to adjust a speed of the fan 54. The rain shield 76 may block contaminants that enter into the outdoor unit 16 from entering the housing 102 of the fan controller 57 via the openings 100. The manner of disposing the rain shield 76 over the fan controller 57 may depend on the configuration of the rain shield 76 (e.g., the different embodiments discussed above with reference to FIGS. 5-16). For example, the rain shield 76 may include an opening (e.g., bottom opening) that receives the fan controller 57, the rain shield 76 may include the first portion 250 and the second portion 252 that are configured to couple to one another and substantially enclose the fan controller 57, and/or the rain shield 76 may include the securement features 320 configured to snap onto the fan controller 57 and couple the rain shield 76 to the fan controller 57.

At block 352, the fan controller 57 and the rain shield 76 may be mounted to the panel 74 via the fasteners 104. For example, the fasteners 104 may extend through the housing 102 of the fan controller 57, through openings 156 of the rain shield 76, and through holes 108 of the panel 74. Additionally, nuts 110 may be tightened onto the fasteners 104 to secure the fan controller 57 and the rain shield 76 to the panel 74. Accordingly, the rain shield 76 may be substantially stationary with respect to the fan controller 57, thereby blocking contaminants from entering into the housing 102 of the fan controller 57 during operation of the outdoor unit 16.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out an embodiment, or those unrelated to enabling the claimed embodiments). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A system, comprising:

a coil of an outdoor unit, wherein tubing forming the coil is configured to circulate a refrigerant therethrough;

a fan configured to direct air from within an inner chamber formed by a structure of the coil such that the air is in a heat exchange relationship with the refrigerant;

a motor located proximate the fan within the inner chamber, wherein the motor is configured to rotate the fan;

a panel coupled to the coil;

a fan controller mounted to the panel such that the fan controller is positioned within the inner chamber remote from the fan and the motor, wherein the fan controller is electrically coupled to the motor, and the fan controller is configured to selectively supply power to the motor to adjust a speed of the fan; and a rain shield disposed over the fan controller and configured to block contaminants from entering into a housing of the fan controller.

2. The system of claim 1, wherein the rain shield is substantially box shaped and is configured to receive the fan controller such that the rain shield substantially covers the fan controller.

3. The system of claim 2, wherein the rain shield comprises a soft sheet metal.

4. The system of claim 1, wherein the rain shield comprises a semi-circular cross section formed by a curved portion and a semi-circular side, and wherein the rain shield is configured to receive the fan controller such that the rain shield substantially covers the fan controller.

5. The system of claim 4, wherein the rain shield comprises a polymeric material.

6. The system of claim 1, wherein the rain shield comprises a first semi-circular portion and a second semi-circular portion, and wherein the first and second semi-circular portions are configured to couple to one another and substantially enclose the fan controller.

7. The system of claim 1, wherein the rain shield comprises a circular cross section, a circular side, a cylindrical surface, and an opening, wherein the opening is configured to receive the fan controller.

8. The system of claim 7, wherein the rain shield is configured to couple to the fan controller via securement features.

9. The system of claim 1, wherein the fan controller comprises wires configured to couple to the motor, and wherein the rain shield comprises an opening configured to guide the wires from the fan controller toward the motor.

10. A system, comprising:

a fan controller comprising a housing, a cover configured to cover an opening of the housing, at least one gap in the housing, the cover, or both, and fasteners configured to couple the cover to the housing, wherein the fan controller is configured to selectively supply power to a motor that drives a fan of an outdoor unit; and a rain shield disposed over the fan controller such that the at least one gap is covered and contaminants are blocked from entering into the housing, wherein the rain shield comprises slots configured to receive the fasteners to couple the rain shield to the fan controller.

11. The system of claim 10, wherein the fan controller is configured to selectively supply power to the motor via wires that extend into the housing or the housing cover through an additional opening.

12. The system of claim 11, wherein the rain shield is configured to cover the additional opening to block contaminants from entering into the housing via the additional opening.

13. The system of claim 11, wherein the rain shield comprises features for guiding the wires toward the motor along a predetermined path to avoid obstruction in the outdoor unit caused by the wires.

14. The system of claim 10, wherein the fan controller and the rain shield are configured to be mounted to a panel of the outdoor unit remote from the fan and the motor, wherein the panel is coupled to a coil of the outdoor unit, and wherein the fan controller and the rain shield are positioned within an inner chamber formed by a structure of the coil.

15. The system of claim 14, comprising nuts configured to be tightened over the fasteners, and wherein the fasteners are configured to extend through holes in the panel to secure the fan controller and the rain shield to the panel.

16. The system of claim 15, wherein the fasteners comprise through bolts and the nuts comprise acorn nuts.

17. A method, comprising:

disposing a rain shield over a fan controller configured to supply power to a motor to adjust a speed of a fan of an outdoor unit, wherein the rain shield is configured to block contaminants entering the outdoor unit from entering into a housing of the fan controller; and mounting the fan controller and the rain shield to a panel of the outdoor unit by disposing fasteners of the fan controller through openings of the panel and tightening nuts about the fasteners, wherein the panel is coupled to a coil of the outdoor unit, and wherein the fan controller and the rain shield are positioned within an inner chamber formed by a structure of the coil when mounted to the panel.

18. The system of claim 17, wherein disposing the rain shield over the fan controller comprises coupling a first portion of the rain shield to a second portion of the rain shield such that the first and second portions enclose the fan controller.

19. The system of claim 17, wherein disposing the rain shield over the fan controller comprises receiving the fan controller in an opening of the rain shield.

20. The system of claim 19, comprising applying a force to the rain shield such that securement features of the rain shield snap onto the fan controller to couple the rain shield to the fan controller.

* * * * *